United States Patent [19]

Pegram

[11] Patent Number: 4,653,830

[45] Date of Patent: Mar. 31, 1987

[54] ELECTRICAL CONNECTOR AND METHOD

[76] Inventor: Warren J. Pegram, 2655 Carriage La., Sumter, S.C. 29154

[21] Appl. No.: 790,525

[22] Filed: Oct. 23, 1985

[51] Int. Cl.[4] ..... H01R 4/24

[52] U.S. Cl. ..... 339/97 R

[58] Field of Search ..... 339/97–99

[56] References Cited

U.S. PATENT DOCUMENTS

| | | | |
|---|---|---|---|
| 3,718,888 | 2/1973 | Pasternak | 339/98 |
| 3,760,335 | 9/1973 | Roberts | 339/99 |
| 3,895,852 | 7/1975 | Wasserlein, Jr. | 339/99 R |
| 4,088,382 | 5/1978 | Ichimura | 339/99 R |
| 4,153,324 | 5/1979 | Kukla | 339/97 R |
| 4,252,397 | 2/1981 | Eigenbrode et al. | 339/99 R |

FOREIGN PATENT DOCUMENTS

| | | | |
|---|---|---|---|
| 2608158 | 9/1977 | Fed. Rep. of Germany | 339/97 R |

*Primary Examiner*—Joseph H. McGlynn

[57] ABSTRACT

An electrical connector and method are presented for forming a juncture with an insulated conductor. The connector includes a grooved member having cutting edges and an angularly disposed insulation separator for easily exposing a large area of the conductor for forming a high current capacity and reliable connection.

16 Claims, 12 Drawing Figures

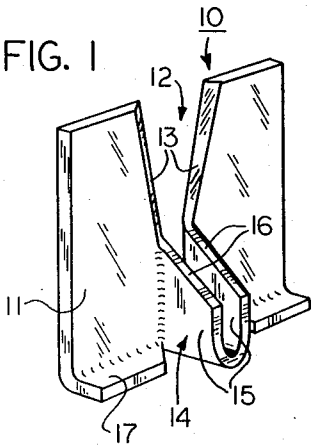
FIG. 1
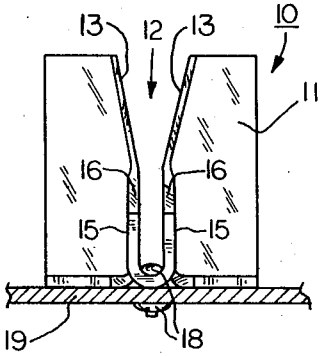
FIG. 2
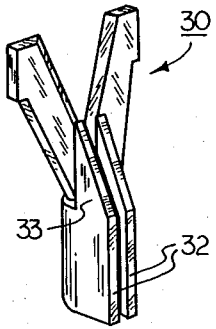
FIG. 5
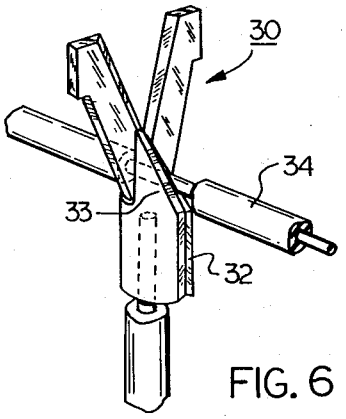
FIG. 6
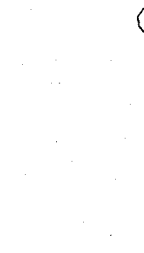
FIG. 3a
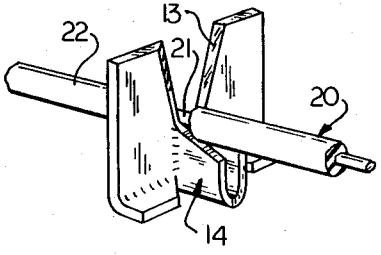
FIG. 3b
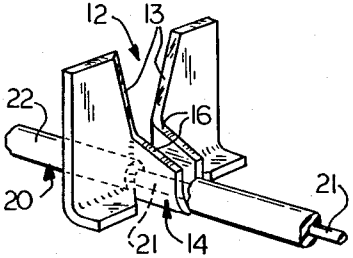
FIG. 3c
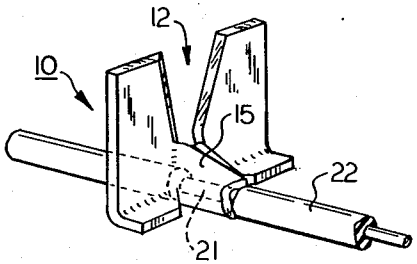
FIG. 3d
FIG. 4a
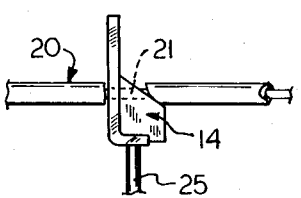
FIG. 4b
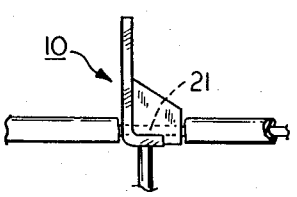
FIG. 4c
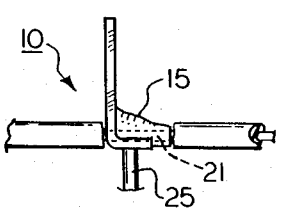
FIG. 4d

ELECTRICAL CONNECTOR AND METHOD

BACKGROUND OF THE INVENTION

1. Field of the Invention

The connector presented herein pertains to joining two or more electrical conductors such as wires to form a quick and convenient union which will insure maximum current flow and which will withstand vibration during use.

2. Description of the Prior Art and Objectives of the Invention

Connectors which are "permanent" or disconnectable types to join one or more conductors to another or other devices such as printed circuit boards have become increasing popular and as most conductors are insulated various devices have been devised to penetrate or remove the insulation to insure a reliable low resistance current flow to the terminals of the connector. Prior art connectors have been developed which include a v-shaped groove with the inner edges of the "v" being sharpened to cut through the insulation of the conductor and nest the conductor in the slot at the bottom of the "v". However, such prior art connectors generally provide only a very slight area of electrical contact since the cutting edge is usually quite thin. Thus, when such prior art connectors (usually referred to as insulation displacement connectors or "IDC's") are used, a connection can be made but such a connection is generally of low cross sectional view and therefore of low current capacity. Furthermore the prior art IDC's are influenced by vibration forces and the conductor often becomes loose causing intermittent electrical contact and poor conduction.

With the disadvantages and limitations known to conventional connectors and methods, the present invention was conceived and one of its objectives is to provide an electrical connector which can be quickly and conveniently used for a wide variety of amperage requirements.

It is another objective of the present invention to provide an electrical connector which is simple in construction and relatively easy and inexpensive to manufacture.

It is yet another objective of the present invention to provide an electrical connector which can be used to join a variety of electrical conductors.

It is still another objective of the present invention to provide an electrical connector and method which will sever and separate the insulation of a desired conductor to expose a relatively wide area of the conductor to insure a good electrical contact area when the conductor is pressed into the present invention.

Yet another objective of the present invention is to provide an electrical connector which is easy to learn to use by the relatively unskilled and which will form a vibration resistant connection for stable electrical conduction.

Other objectives and advantages of the present invention become apparent to those skilled in the art as a more complete explanation of the invention is demonstrated below.

SUMMARY OF THE INVENTION

The present invention comprises an electrical connector for joining electrical conductors or the like whereby one of said conductors includes an insulated covering. The connector of the invention comprises a groove having cutting edges and an angularly disposed insulation separator affixed proximate the groove to space the insulation along the wire once the cutting edges have penetrated and divided either totally or partially the insulation into two segments. The exposed conductor is then available as a larger than usual contact area with the terminal of the connector.

The method of the invention includes separating the insulation on an electrical conductor by severing the insulation by pressing or urging the conductor into a groove having cutting edges thereon and thereafter directing the conductor along a member angularly disposed to the groove to thereby additionally part the severed insulation along or through the conductor thus exposing an extended surface area or zone of the conductor for electrical contact.

BRIEF DESCRIPTION OF THE DRAWINGS

FIG. 1 demonstrates a typical embodiment of the electrical connector of the invention in perspective fashion;

FIG. 2 illustrates the connector of FIG. 1 mounted on a support;

FIGS. *3a–3d* illustrate the connector in perspective steps being joined to the conductor;

FIGS. *4a–4d* demonstrate the connecting process of FIG. 3 in side elevational views;

FIG. 5 demonstrates a second embodiment of the invention in a perspective open configuration; and FIG. 6 demonstrates the embodiment of the connector of FIG. 5 shown in a closed or joined configuration.

DESCRIPTION OF THE PREFERRED EMBODIMENTS

The preferred form of the invention is shown in FIG. 1 and includes a substantially planar base with a v-shaped groove having sharpened cutting edges. This v-shaped groove can contain a conductive component in contact with the exposed conductor; however, the insulation separator may be non-conducting or semi-conducting. Below the v-shaped groove is an extended slot. Attached near the bottom of the "v" at a substantially right angle thereto is a trough member having side walls with top surfaces which are biased or slanted downwardly from the groove.

The preferred method of the invention includes separating the insulation along an electrical conductor by urging the insulated conductor into the v-shaped groove whereby the insulation is severed by the cutting edges of the groove. Thereafter by continuing to urge the conductor downwardly into the trough the side walls with biased top surfaces which decline from the groove cause the insulation to additionally part along the conductor allowing a large portion of the conductor to be exposed to provide a low resistance contact zone or area for forming an electrical juncture.

DETAILED DESCRIPTION OF THE DRAWINGS

For a more complete understanding of the invention, turning now to the drawings, connector 10 as shown in FIG. 1 includes a substantially planar base 11 formed from a conductive metal such as brass or copper and which includes an intermediate substantially v-shaped notch or groove 12 having edges 13 which are sharp and are capable of cutting conductor insulation such as vinyl, rubber or the like. Near the bottom of the v-shaped groove 12 and communicating therewith is trough member or separating means 14 which is attached at a substantially right angle to planar base 11. Trough member 14 has an arcuate shaped bottom 28 which may be integrally formed with base member 11 and includes a pair of side walls 15 which are angularly disposed to base 11 by having biased top surfaces 16 which slope downwardly and away from base 11. Foot 17 may also be formed at approximately a right angle to base 11 and will assist in providing mounting stability as shown in FIG. 2. In FIG. 2 a typical mounting of connector 10 is illustrated in which rivet 18 joins connector 10 to support 19 which may be an insulator or may be a conducting surface as desired and may be an integral part of connector 10.

The method of use of connector 10 is shown in FIG. 3(*a*) with insulated conductor 20 initially urged into groove 12. As seen insulation 22 is cut deeper by cutting means or edges 13 as insulated conductor 20 is further urged into groove 12 in FIG. 3(*b*). As seen in FIG. 3(*c*) insulation 22 has been separated along conductor 21 as conductor 21 passes vertically downwardly into trough member 14. As would be understood conductor 21 tightly fits between walls 15 for good electrical contact. Biased top surfaces 16 of trough member 14 cause insulation 22 to part along conductor 21 as seen in FIGS. 4(*b*) and 4(*c*). A final step in making a good electrical contact is shown in FIG. 3(*d*) wherein the side walls 15 of separating means 14 have been swaged into firm engagement with the large exposed area of conductor 21. FIGS. 4(*a*)–4(*d*) shown substantially the same steps of forming a connection as in FIGS. 3(*a*) through 3(*d*) but in side elevational views rather than in perspective views. FIG. 4 also includes a second conducting means 25 as may be joined to connector 10 or may be continuous with connector 10.

As shown in FIG. 6 connector 30 having an intermediate substantially v-shaped groove 31 includes a crimpable conductor attachment 32 and separating means 33. In FIG. 6 separating means 33 has been folded to retain conductor 34 therein in secure fashion.

Various types and styles of connectors can be manufactured utilizing the principles as herein described and can range in size from very tiny to very large depending on the application requirements. Connectors 10 and 30 are but a few of the various embodiments which can be formed utilizing the principles of the invention herein described and said connectors may be combined or formed to stack or join in series or in parallel fashion and may be made from copper, aluminum or other conducting, semi-conducting or non-conducting materials. Such illustrations and examples presented herein are for explanatory purposes and are not intended to limit the scope of the appended claims.

I claim:

1. An electrical connector comprising: cutting means and insulation separating means, said separating means joined to said cutting means, said separating means including a side wall for receiving a conductor therealong to provide a continuous contact area between the conductor and the connector, said contact area being at least twice as wide as the thickness of said cutting means.

2. An electrical connector as claimed in claim 1 wherein said separating means is angularly disposed to said cutting means.

3. An electrical connector comprising a substantially planar base, said planar base having a groove therein, said groove having a cutting edge, insulation separating means, said separating means joined to said planar base, and said separating means including a pair of substantially planar parallel side walls, said side walls providing a continuous contact area for a conductor, said contact area being at lease twice as wide as said cutting edge.

4. An electrical connector as claimed in claim 3 wherein said groove is substantially v-shaped.

5. An electrical connector as claimed in claim 3 wherein said separating means is angularly joined to said planar base.

6. An electrical connector as claimed in claim 3 wherein said side walls are connected to each other along the bottom by a u-shaped trough, said trough communicating with said groove.

7. An electrical connector as claimed in claim 6 wherein said side walls have biased top surfaces.

8. An electrical connector comprising: a base, said base defining a groove, said groove having a cutting edge, insulation separating means, said separating means having a pair of substantially parallel side walls, said side walls having biased top surfaces, said side walls joined to said base whereby the insulation of an insulated conductor when urged into said groove will be severed by said cutting edge and thereafter the insulation will be additionally parted along the conductor by said top surfaces of said side walls, said side walls for providing a continuous area of contact with the conductor, said area of contact being substantially equal to the length of insulation separation.

9. An electrical connector as claimed in claim 8 wherein said base comprises a substantially planar member.

10. An electrical connector as claimed in claim 8 wherein said groove is substantially v-shaped.

11. An electrical connector as claimed in claim 8 wherein said separating means includes a trough, said trough joined to the bottom of said side walls for receiving said conductor.

12. An electrical connector as claimed in claim 11 wherein said trough member includes a pair of side walls, said side walls positioned proximate said groove.

13. A method of separating the insulation along an electrical conductor comprising the steps of: severing the insulation on the conductor by urging the insulated conductor into a groove having a cutting edge and thereafter urging the conductor along a separating means having a side wall at least twice as wide as the cutting edge, said side wall being angularly disposed to the groove, additionally parting the severed insulation with said separating means, said side wall forming a continuous area of contact between the conductor and the side wall.

14. A method of separating the insulation on an electrical conductor as claimed in claim 13 wherein the step of urging the insulated conductor into a groove comprises directing the conductor into a substantially v-shaped groove.

15. A method of separating the insulation on an electrical conductor as claimed in claim 13 wherein the step of urging the conductor along a separating means having a side wall angularly disposed to the groove comprises urging the conductor along a separating means having a pair of side walls positioned proximate the groove.

16. A method of separating the insulation on an electrical conductor as claimed in claim 15 wherein the step of urging the conductor along a separating means proximate the groove comprises urging the conductor along the side walls of the separating means and then into a trough at the bottom of the walls.

* * * * *